US009709262B2

(12) United States Patent
Tonomura et al.

(10) Patent No.: US 9,709,262 B2
(45) Date of Patent: Jul. 18, 2017

(54) SUPERHEATED STEAM RECYCLING APPARATUS AND METHOD FOR USING SAME

(71) Applicant: TOKUDEN CO., LTD., Kyoto-shi, Kyoto (JP)

(72) Inventors: Toru Tonomura, Otsu (JP); Yasuhiro Fujimoto, Kyoto (JP)

(73) Assignee: Tokuden Co., Ltd., Kyoto-shi, Kyoto (JP)

( * ) Notice: Subject to any disclaimer, the term of this patent is extended or adjusted under 35 U.S.C. 154(b) by 66 days.

(21) Appl. No.: 14/673,597

(22) Filed: Mar. 30, 2015

(65) Prior Publication Data

US 2015/0276210 A1 Oct. 1, 2015

(30) Foreign Application Priority Data

Mar. 31, 2014 (JP) ..... 2014-070805
Feb. 12, 2015 (JP) ..... 2015-024976

(51) Int. Cl.
*F22G 5/00* (2006.01)
*F22G 5/06* (2006.01)

(52) U.S. Cl.
CPC . *F22G 5/00* (2013.01); *F22G 5/06* (2013.01)

(58) Field of Classification Search
CPC ..... F01K 17/06; F22B 1/02; F22G 5/00
(Continued)

(56) References Cited

U.S. PATENT DOCUMENTS 2,960,972 A * 11/1960 Schaap ..... F22B 21/343 122/379
3,472,207 A * 10/1969 Foldes ..... F22B 29/12 122/406.5

(Continued)

FOREIGN PATENT DOCUMENTS

FR 1279880 A 12/1961
GB 960378 A 6/1964

(Continued)

OTHER PUBLICATIONS

European Patent Office, Extended European Search Report Issued in Application No. 15160610.0, Sep. 7, 2015, Germany, 6 pages.

*Primary Examiner* — Gregory A Wilson
(74) *Attorney, Agent, or Firm* — Alleman Hall Creasman & Tuttle LLP

(57) ABSTRACT

A superheated steam recycling apparatus includes a superheated steam generating part; a steam supply flow path for supplying saturated steam to the superheated steam generating part; a superheated steam utilization part that is supplied with superheated steam generated by the superheated steam generating part; a steam return flow path for returning used steam having passed through the superheated steam utilization part to the superheated steam generating part; and a flowmeter that measures a flow rate of the used steam returned to the superheated steam generating part, and on the basis of the difference between a desired flow rate of the superheated steam to be generated by the superheated steam generating part and the flow rate of the used steam obtained by the flowmeter, controls a flow rate of the saturated steam to be supplied to the superheated steam generating part through the steam supply flow path.

7 Claims, 4 Drawing Sheets

(58) Field of Classification Search
USPC ..... 122/106.1, 479.2, 479.1, 479.6, 479.5, 122/487, 488
See application file for complete search history.

(56) References Cited

U.S. PATENT DOCUMENTS

| | | | | | |
|---|---|---|---|---|---|
| 4,552,099 | A * | 11/1985 | Martens | F01K 23/108 | 122/406.4 |
| 5,605,118 | A * | 2/1997 | Sinn | F22G 5/00 | 122/4 A |
| 7,966,977 | B2 * | 6/2011 | Schu | F01K 3/183 | 122/36 |
| 9,021,809 | B2 * | 5/2015 | Block | F01K 17/06 | 60/653 |
| 2008/0053127 | A1 | 3/2008 | Takahashi et al. | | |
| 2010/0263607 | A1 * | 10/2010 | Travaly | F22D 1/34 | 122/476 |
| 2014/0014311 | A1 | 1/2014 | Lach | | |
| 2014/0116052 | A1 * | 5/2014 | Noguchi | F01K 7/22 | 60/679 |
| 2015/0114320 | A1 * | 4/2015 | Beveridge | F22G 5/00 | 122/479.1 |
| 2015/0167499 | A1 | 6/2015 | Shinozaki et al. | | |

FOREIGN PATENT DOCUMENTS

| | | | |
|---|---|---|---|
| JP | 2006226561 | A | 8/2006 |
| WO | 2014014027 | A1 | 1/2014 |

* cited by examiner

SUPERHEATED STEAM RECYCLING APPARATUS AND METHOD FOR USING SAME

TECHNICAL FIELD

The present invention relates to a superheated steam recycling apparatus that recycles superheated steam, and to a method for using the apparatus.

BACKGROUND ART

In recent years, superheated steam processing apparatuses that use superheated steam to wash, dry, and sterilize processing objects have been devised.

It will be noted that, regarding steam, latent heat necessary for a state change from water at boiling point to steam at boiling point is the largest, and for example, referring to superheated steam at 700° C., the ratio between a heat quantity necessary to change water at 60° C. into saturated steam at 130° C. and a heat quantity necessary to change saturated steam at 130° C. into superheated steam at 700° C. is approximately 2:1. That is, disposing of steam after use leads to a large calorific loss, and therefore recycling of used steam is desirable.

Apparatuses adapted to recycle superheated steam include, as disclosed in Patent Literature 1, a heat treatment device that is configured to, on the basis of the temperature inside a heat treatment chamber, control the temperature and supply a quantity of superheated steam supplied from a superheating device to the heat treatment chamber, and control a returning flow rate of the superheated steam returned to a steam inlet side of the superheating device.

However, the heat treatment device described above controls the returning flow rate of the superheated steam returned to the steam inlet side of the superheating device, on the basis of the temperature inside the heat treatment chamber. Accordingly, part of the used steam having passed through the heat treatment chamber is discharged, and therefore the heat treatment device does not fundamentally solve the calorific loss problem.

CITATION LIST

Patent Literature

Patent Literature 1: JP-A2006-226561

SUMMARY OF INVENTION

Technical Problem

Therefore, the present invention is made in order to solve the above problem, and a main intended object thereof is to effectively utilize used superheated steam to suppress calorific loss as well as minimize a heat quantity necessary to generate saturated steam from water in order to generate superheated steam.

Solution to Problem

That is, a superheated steam recycling apparatus according to the present invention includes a superheated steam generating part that generates superheated steam; a steam supply flow path for supplying saturated steam or superheated steam to the superheated steam generating part; a superheated steam utilization part that is supplied with the superheated steam generated by the superheated steam generating part; a steam return flow path for returning used steam having passed through the superheated steam utilization part to the superheated steam generating part; and a flowmeter that is provided in the steam return flow path to measure a flow rate of the used steam returned to the superheated steam generating part, and on the basis of the difference between a desired flow rate of the superheated steam to be generated by the superheated steam generating part and the flow rate of the used steam obtained by the flowmeter, controls a flow rate of the saturated steam or the superheated steam to be supplied to the superheated steam generating part through the steam supply flow path.

The superheated steam recycling apparatus as described above is configured to return the used steam having passed through the superheated steam utilization part to the superheated steam generating part through the steam return flow path, and therefore calorific loss caused by disposing of the used steam can be suppressed. Also, the superheated steam recycling apparatus returns the used steam to the superheated steam generating part while preventing a state change of the used steam into water to make the used steam keep latent heat. This can also suppress calorific loss. Further, on the basis of the difference between the desired flow rate of the superheated steam to be generated by the superheated steam generating part and the flow rate of the used steam returned to the superheated steam generating part, the flow rate of the saturated steam or the superheated steam to be supplied to the superheated steam generating part through the steam supply flow path is controlled, and therefore a heat quantity necessary to generate saturated steam from water can be minimized.

More specifically, a deficit of the flow rate of the used steam obtained by the flowmeter with respect to the desired flow rate of the superheated steam to be generated by the superheated steam generating part is desirably compensated for by the flow rate of the saturated steam or the superheated steam supplied to the superheated steam generating part through the steam supply flow path.

The steam return flow path is provided with various devices including the flowmeter. This gives rise to various problems because part of the used steam is cooled and changes back into water in the middle of passing through the steam return flow path. For example, the warm water produced by cooling the used steam is discharged, causing calorific loss. Also, in a situation where the used steam and the warm water are mixed with each other, or contact with high-temperature and low-temperature devices to repeat liquefaction and vaporization, it is difficult to stabilize steam temperature. Further, water hammer caused by a large variation in volume due to the steam liquefaction and vaporization may lead to damage to the piping, devices, and the like.

In order to solve these problems, desirably, the superheated steam recycling apparatus includes a heating device that is provided in the steam return flow path to perform heating such that the used steam keeps a temperature equal to or more than the boiling point from the superheated steam utilization part to the superheated steam generating part.

A specific embodiment of the heating device may be, for example, an induction heating device that inductively heats the piping or an electrical heating device that electrically heats the piping. Further, it is desirable to perform a cascade control that detects the temperature of the steam at the end point of the steam return flow path (at the connecting point between the steam return flow path and the superheated steam generating part (at the inlet part of the superheated steam generating part)), and makes the steam temperature at the end point of the steam return flow path equal to or more than the boiling point.

It is difficult to bring the superheated steam utilization part adapted to utilize superheated steam or the steam return flow path into a completely closed state, and therefore the used steam returning to the superheated steam generating part through the steam return flow path may be mixed with air. For this reason, desirably, the superheated steam recycling apparatus includes an air removing device that is provided in the steam return flow path to remove air contained in the used steam. In doing so, air can be removed from the used steam, and consequently, the concentration of oxygen in the superheated steam can be reduced to obtain higher heat transfer characteristics.

Desirably, the superheated steam recycling apparatus includes a steam ejector that is provided in the steam supply flow path, is connected with the steam return flow path, and sucks the used steam through the steam return flow path. In doing so, the used steam can be returned to the superheated steam generating part by the action of the steam ejector without using an external driving force.

As a specific embodiment of the superheated steam recycling apparatus, desirably, the superheated steam recycling apparatus includes a saturated steam generating part that generates saturated steam, and the steam supply flow path connects the saturated steam generating part and the superheated steam generating part to each other.

In doing so, only by supplying water to the superheated steam recycling apparatus, superheated steam can be supplied to the superheated steam utilization part. Also, the need for another saturated steam generating device provided outside the superheated steam recycling apparatus can be eliminated, and consequently the need for external piping for connecting them to each other can be eliminated.

The used steam flowing through the steam return flow path may contact with lower temperature parts in the steam return flow path (such as the piping forming the steam return flow path and the various devices provided in the steam return flow path) and partially change back into water even when heated to a temperature equal to or more than the boiling temperature by the heating device. For this reason, desirably, the superheated steam recycling apparatus includes a steam-water separating device that is provided in the steam return flow path to remove moisture contained in the used steam; and a water return flow path for returning water, which results from separation by the steam-water separating device, to the saturated steam generating part.

Also, a method for using a superheated steam recycling apparatus according to the present invention is a method for using a superheated steam recycling apparatus that includes a superheated steam generating part that generates superheated steam; a steam supply flow path for supplying saturated steam or superheated steam to the superheated steam generating part; a superheated steam utilization part that is supplied with superheated steam generated by the superheated steam generating part; a steam return flow path for returning used steam having passed through the superheated steam utilization part to the superheated steam generating part; and a flowmeter that is provided in the steam return flow path to measure a flow rate of the used steam returned to the superheated steam generating part, and on the basis of the difference between a desired flow rate of the superheated steam to be generated by the superheated steam generating part and the flow rate of the used steam obtained by the flowmeter, controls a flow rate of the saturated steam or the superheated steam to be supplied to the superheated steam generating part through the steam supply flow path.

Advantageous Effects of Invention

The present invention configured as described can effectively utilize used superheated steam to suppress calorific loss as well as minimize a heat quantity necessary to generate saturated steam from water in order to generate superheated steam.

DESCRIPTION OF EMBODIMENTS

One embodiment of a superheated steam recycling apparatus according to the present invention is described below with reference to the drawings.

Figure 1:
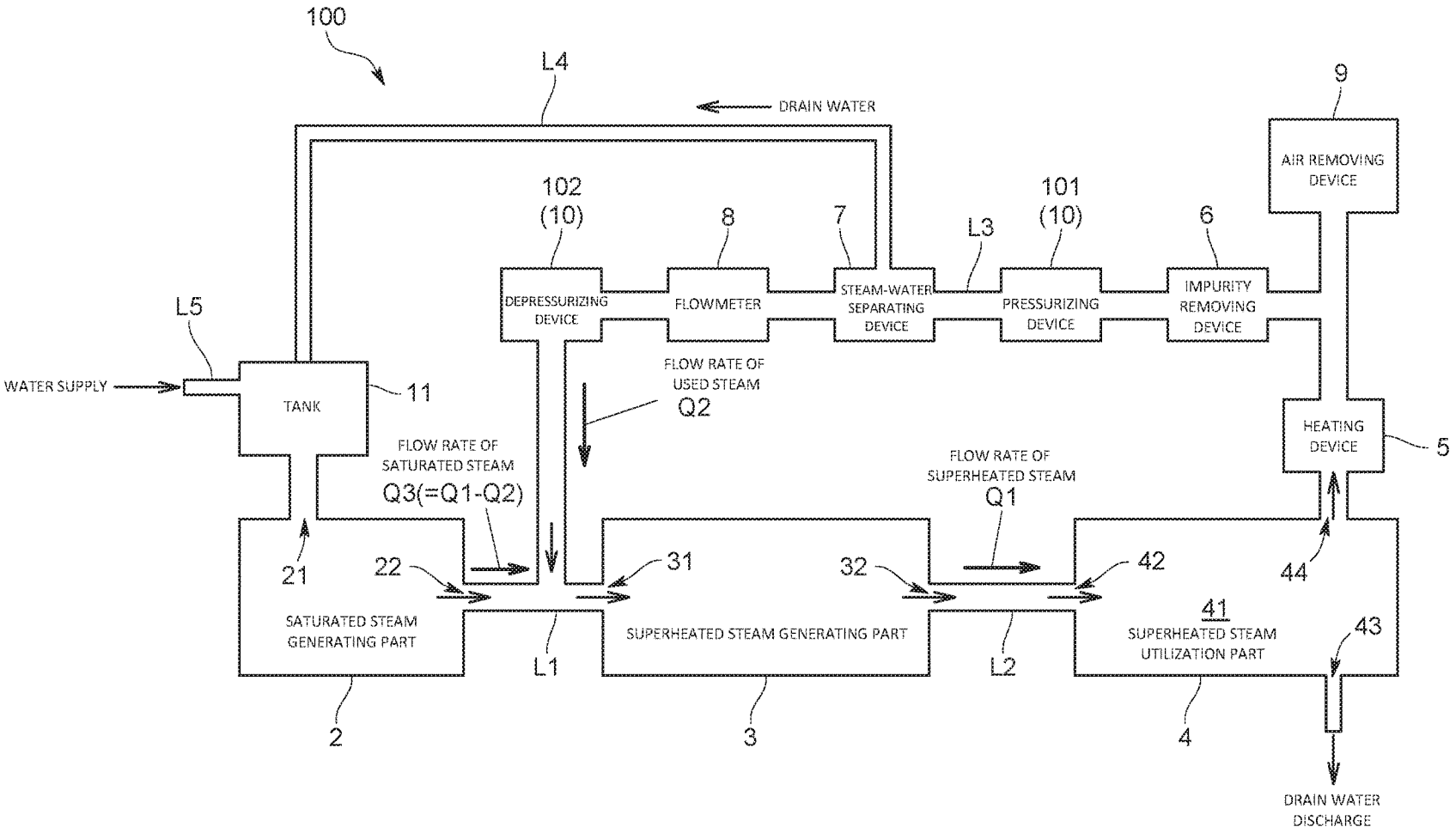
FIG. 1 is a diagram schematically illustrating a configuration of a superheated steam recycling apparatus of the present embodiment.

A superheated steam recycling apparatus 100 according to the present embodiment is one that, without discharging used steam, circulates the used steam to recycle it for processing a processing object. As illustrated in FIG. 1, the superheated steam recycling apparatus 100 includes a saturated steam generating part 2 that generates saturated steam from water; a superheated steam generating part 3 that generates superheated steam from the saturated steam generated by the saturated steam generating part 2; and a superheated steam utilization part 4 that is supplied with the superheated steam generated by the superheated steam generating part 3.

The saturated steam generating part 2 is, for example, of an induction heating type or an electrical heating type, and has an introduction port 21 for introducing water, and a lead-out port 22 for leading out the saturated steam. In the case of the induction heating type, the saturated steam generating part 2 may be one that includes, for example, a coiled hollow conductive tube (not illustrated) having the introduction port 21 and the lead-out port 22; an induction coil (not illustrated) for inductively heating the hollow conductive tube; and an AC power supply circuit (not illustrated) for applying AC voltage to the induction coil, and by applying the AC voltage to the induction coil, applies induced current to the hollow conductive tube to cause Joule heating, and causes a state change of the water introduced into the hollow conductive tube into saturated steam. On the other hand, in the case of the electrical heating type, the saturated steam generating part 2 may be one that includes, for example, a coiled or straight tubular hollow conductive tube (not illustrated) having the introduction port 21 and the lead-out port 22; and a DC power supply circuit (not illustrated) for applying DC voltage to the hollow conductive tube, and by applying DC current to the hollow conductive tube, causes Joule heating, and causes a state change of the water introduced into the hollow conductive tube into saturated steam. In any of these cases, by controlling the voltage applied to the hollow conductive tube or controlling the current flowing through the hollow conductive tube, the temperature of the saturated steam led out of the lead-out port 22 of the hollow conductive tube is controlled.

The superheated steam generating part 3 is, as with the saturated steam generating part 2, for example, of an induction heating type or an electrical heating type, and has an introduction port 31 for introducing the saturated steam; and a lead-out port 32 for leading out the superheated steam. In the case of the induction heating type, the superheated steam generating part 3 may be one that includes, for example, a coiled hollow conductive tube (not illustrated) having the introduction port 31 and the lead-out port 32; an induction coil (not illustrated) for inductively heating the hollow conductive tube; and an AC power supply circuit (not illustrated) for applying AC voltage to the induction coil, and by applying the AC voltage to the induction coil, applies induced current to the hollow conductive tube to cause Joule heating, and causes a state change of the saturated steam introduced into the hollow conductive tube into superheated steam. On the other hand, in the case of the electrical heating type, the superheated steam generating part 3 may be one that includes, for example, a coiled or straight tubular hollow conductive tube having the introduction port 31 and the lead-out port 32; and a DC power supply circuit for applying DC voltage to the hollow conductive tube, and by applying DC current to the hollow conductive tube, causes Joule heating, and causes a state change of the saturated steam introduced into the hollow conductive tube into superheated steam. In any of these cases, by controlling the voltage applied to the hollow conductive tube or controlling the current flowing through the hollow conductive tube, the temperature of the superheated steam led out of the lead-out port 32 of the hollow conductive tube is controlled.

The superheated steam utilization part 4 is one that thermally processes (e.g., washes, dries, sinters, or sterilizes) a processing object with the superheated steam, and has a processing object containing part 41 that contains the processing object as well as forms a closed space or a substantially closed space; an introduction port 42 that is provided for the processing object containing part 41 to introduce the superheated steam; a drain discharge port 43 for discharging drain water produced in the processing object containing part 41; and a steam discharge port 44 for discharging used steam passing through the processing object containing part.

In addition, in the superheated steam recycling apparatus 100, the saturated steam generating part 2 and the superheated steam generating part 3 are connected to each other by a steam supply flow path L1 (hereinafter referred to as a saturated steam supply flow path L1) for supplying the saturated steam generated by the saturated steam generating part 2 to the superheated steam generating part 3. Specifically, the saturated steam supply flow path L1 is one that connects the lead-out port 22 of the saturated steam generating part 2 and the introduction port 31 of the superheated steam generating part 3 to each other.

Similarly, the superheated steam generating part 3 and the superheated steam utilization part 4 are connected to each other by a superheated steam supply flow path L2 for supplying the superheated steam generated by the superheated steam generating part 3 to the superheated steam utilization part 4. Specifically, the superheated steam supply flow path L2 is one that connects the lead-out port 32 of the superheated steam generating part 3 and the introduction port 42 of the superheated steam utilization part 4 to each other.

Further, the superheated steam recycling apparatus 100 of the present embodiment has a steam return flow path L3 for returning the used steam having passed through the superheated steam utilization part 4 to the superheated steam generating part 3. The steam return flow path L3 in the present embodiment is one for returning the used steam to the superheated steam generating part 3 through the introduction port 31 by returning the used steam to the saturated steam supply flow path L1 between the saturated steam generating part 2 and the superheated steam generating part 3. Specifically, the steam return flow path L3 is one that connects the steam discharge port 44 of the superheated steam utilization part 4 and the saturated steam supply flow path L1 to each other. Note that the steam return flow path L3 may be configured to be directly connected to the superheated steam generating part 3 without being connected to the saturated steam supply flow path L1.

The steam return flow path L3 is provided with a heating device 5, impurity removing device 6, steam-water separating device 7, and flowmeter 8 in this order from the steam discharge port 44 side of the superheated steam utilization part 4.

The heating device 5 is one that performs heating such that the used steam keeps temperature (e.g., 100° C. or more) equal to or more than the boiling point from the superheated steam utilization part 4 to the superheated steam generating part 3. One possible temperature control by the heating device is a cascade control that uses an unillustrated temperature sensor to detect the temperature of the used steam, for example, at the end point of the steam return flow path L3, in the present embodiment, at the connecting point between the steam return flow path L3 and the saturated steam supply flow path L1, and makes the detected temperature of the used steam equal to or more than the boiling point. Since the heating device 5 heats the used steam such that the used steam keeps the temperature equal to or more than the boiling point up to the superheated steam generating part 3, calorific loss due to liquefaction, a variation in steam temperature, and damage due to water hammer can be suppressed.

The impurity removing device 6 is one that, from the used steam, removes impurities produced by the thermal processing using the superheated steam. As the impurity removing device 6, it is necessary to select or fabricate a suitable device for each of the materials to be removed; however, it should be appreciated that a device adapted to remove impurities while cooling down the used steam to lower the temperature to equal to or less than the boiling temperature is not suitable. That is, the impurity removing device 6 is one having a performance that removes the impurities from the used steam at a temperature equal to or more than the boiling temperature. It will be noted that the impurity removing device 6 may be one that heats the used steam to a predetermined temperature equal to or more than the boiling point for component decomposition, and removes the impurities; however, in such a case, the heating device 5 may be configured to share the roles of the impurity removing device 6.

The steam-water separating device 7 is one that removes moisture contained in the used steam. The steam-water separating device 7 is connected with a water return flow path L4 for returning drain water, which results from separation by the steam-water separating device 7, to the saturated steam generating part 2. Specifically, the water return flow path L4 is connected to a tank 11 connected to the introduction port 21 of the saturated steam generating part 2.

Further, the tank 11 is connected with a water supply flow path L5 in addition to the water return flow path L4.

The flowmeter 8 is one that measures a flow rate of the used steam returned to the superheated steam generating part 3. In the present embodiment, the flowmeter 8 is configured to measure the flow rate of the used steam from which air, impurities, and water were removed by a below-described air removing device 9, the impurity removing device 6, and the steam-water separating device 7, respectively. In doing so, the flow rate of the used steam returned to the superheated steam generating part 3 can be accurately measured.

In addition, in the steam return flow path L3, the air removing device 9 is provided between the heating device 5 and the impurity removing device 6. The air removing device 9 is one that removes air contained in the used steam, and includes, for example, a chamber forming an air accumulation space and a discharge valve provided for the chamber. Since the air removing device 9 removes the air contained in the used steam, the concentration of oxygen in the superheated steam can be reduced to obtain higher heat transfer characteristics.

Further, in the steam return flow path L3, a pressure regulating mechanism 10 adapted to regulate the pressure of the used steam returned to the superheated steam generating part 3 is provided.

The pressure regulating mechanism 10 is one that restores the reduced pressure of the used steam having passed through the superheated steam utilization part 4, and is configured to include a pressurizing device 101 such as a pressurizing pump and a depressurizing device 102 such as a pressure reducing valve. In the present embodiment, the pressurizing device 101 is provided on a downstream side of the impurity removing device 6 and the steam-water separating device 7, and the depressurizing device 102 is provided between the steam-water separating device 7 and the flowmeter 8. The pressurizing device 101 and the depressurizing device 102 perform control so as to make the pressure of the used steam returned to the saturated steam supply flow path L1 through the steam return flow path L3 equal to the pressure of the saturated steam led out of the lead-out port 22 of the saturated steam generating part 2. In doing so, the pressure of the superheated steam generated by recycling the used steam can be prevented from being reduced.

Actions associated with recycling the superheated steam in the superheated steam recycling apparatus 100 configured in the above manner are described.

In the initial stage of operation, saturated steam is generated by the saturated steam generating part 2, and superheated steam is also generated by the superheated steam generating part 3 and then supplied to the superheated steam utilization part 4. In doing so, used steam, having passed through the superheated steam utilization part 4, returns to the saturated steam supply flow path L1 and the superheated steam generating part 3 through the steam return flow path L3.

In this stage, on the basis of a flow rate of the used steam measured by the flowmeter 8, a flow rate of saturated steam to be supplied to the superheated steam generating part 3 through the saturated steam supply flow path L1, i.e., a flow rate of the saturated steam generated by the saturated steam generating part 2 is controlled.

Specifically, on the basis of the difference between a desired flow rate of the superheated steam to be generated by the superheated steam generating part 3 and the flow rate of the used steam obtained by the flowmeter 8, the flow rate of the saturated steam or superheated steam to be supplied to the superheated steam generating part 3 through the saturated steam supply flow path L1 is controlled. More specifically, the flow rate (Q3) of the saturated steam to be supplied to the superheated steam generating part 3 through the saturated steam supply flow path L1 is set to a deficit (Q1-Q2) of the flow rate (Q2) of the used steam obtained by the flowmeter 8 with respect to the desired flow rate (Q1) of the superheated steam to be generated by the superheated steam generating part 3.

In the present embodiment, in a flow path between the saturated steam generating part 2 and the tank 11, a flow rate control mechanism such as a mass flow controller is provided, and by controlling the flow rate control mechanism to control the amount of water to be supplied to the saturated steam generating part 2, the amount of saturated steam to be supplied from the saturated steam generating part 2 to the superheated steam generating part 3 is controlled. In addition, the flow rate control mechanism may be automatically controlled by an unillustrated control device. Alternatively, by controlling the power supply circuit of the saturated steam generating part 2 with an unillustrated control device, the flow rate of the saturated steam to be generated may be controlled. Further, by providing the saturated steam supply flow path L1 with a flow rate control mechanism such as a mass flow controller and controlling the flow rate control mechanism with an unillustrated control device, the flow rate of the saturated steam to be supplied to the superheated steam generating part 3 through the saturated steam supply flow path L1 may be controlled.

Next description is given of the result of a superheated steam recycling test using the superheated steam recycling apparatus 100 of the present embodiment.

1. Operating conditions

Superheated steam output temperature: 250° C.

Saturated steam temperature: 130° C.

Water inflow rate: 32.75 kg/h

Electric energy: 29.83 kW

2. Calculation

Saturated steam generating power: 24.37 kW

Superheated steam generating power=Total electric energy−Saturated steam generating power=29.83−24.37=5.46 kW Power necessary to generate 32.75 kg of superheated steam is 2.72 kW, and therefore, Power for recycled steam=5.46−2.72=2.74 kW Given that steam at 250° C. is fed back at 100° C. (not measured), the amount of steam of which temperature can be raised from 100° C. to 250° C. by 2.74 kW power is approximately 33 kg.

Given that the feedback steam temperature is from 100° C. to 250° C., it can be determined that at least 33 kg of steam is recycled.

Total steam amount=32.75+33=65.75 kg/h

Recycled steam amount=33 kg/h

In terms of power, the recycled steam amount of 33 kg/h includes saturated steam generating power, of which a value is 24.56 kW/h.

Accordingly, the recycled steam contains energy equivalent to an electric energy of 2.74+24.56=27.3 kW.

In other words, the calculation exhibits that the power necessary to generate 65.75 kg/h of 250° C. superheated steam without recycling is approximately 54.4 kW (=24.37+24.56+5.46), and approximately 50% of the power is recycled.

The superheated steam recycling apparatus 100 described above is configured to return the used steam having passed through the superheated steam utilization part 4 to the superheated steam generating part 3 through the steam return flow path L3, and can therefore suppress calorific loss caused by disposing of the used steam. Also, the superheated steam recycling apparatus 100 returns the used steam to the superheated steam generating part 3 while preventing a state change of the used steam into water to make the used steam keep latent heat. This can also suppress calorific loss. Further, on the basis of the difference between the desired flow rate of the superheated steam to be generated by the superheated steam generating part 3 and the flow rate of the used steam returned to the superheated steam generating part 3, the flow rate of the saturated steam to be supplied to the superheated steam generating part 3 through the saturated steam supply flow path L1 is controlled, and therefore a heat quantity necessary to generate the saturated steam from water can be minimized.

Note that the present invention is not limited to the above-described embodiment.

Figure 2:
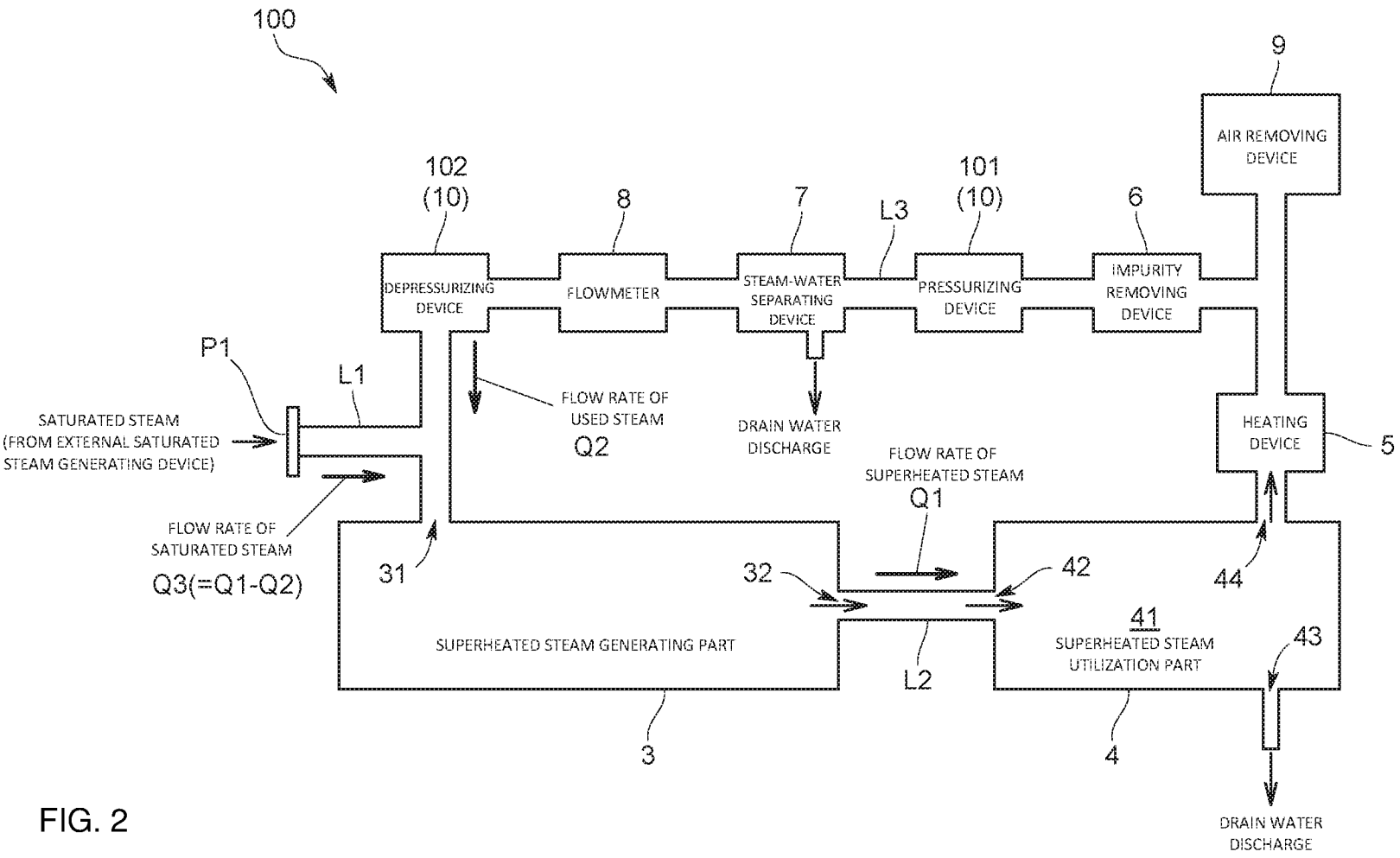
FIG. 2 is a diagram schematically illustrating a configuration of a superheated steam recycling apparatus of another embodiment.

For example, the superheated steam recycling apparatus 100 of the above-described embodiment has the saturated steam generating part 2, but may not have the saturated steam generating part 2. In such a case, as illustrated in FIG. 2, the superheated steam recycling apparatus 100 has a saturated steam introduction port P1 for receiving saturated steam generated by a saturated steam generating device (not illustrated) provided separately from the superheated steam recycling apparatus 100, and the saturated steam introduction port P1 is connected with the saturated steam supply flow path L1. Also, the superheated steam recycling apparatus 100 does not include the tank 11 for supplying water to the saturated steam generating part 2, and therefore may be configured to return drain water, which results from separation by the steam-water separating device 7, to a tank (not illustrated) of the external saturated steam generating device.

Further, in the above-described embodiment, the superheated steam generating part 3 is configured to receive saturated steam generated by the saturated steam generating part 2 provided in the preceding stage; however, in the case where the saturated steam generating part 2 is one that further heats the saturated steam to generate superheated steam, the superheated steam generating part 3 may be configured to receive the superheated steam, further heat the received superheated steam, and generate superheated steam having a desired temperature to be supplied to the superheated steam utilization part 4.

Figure 3:
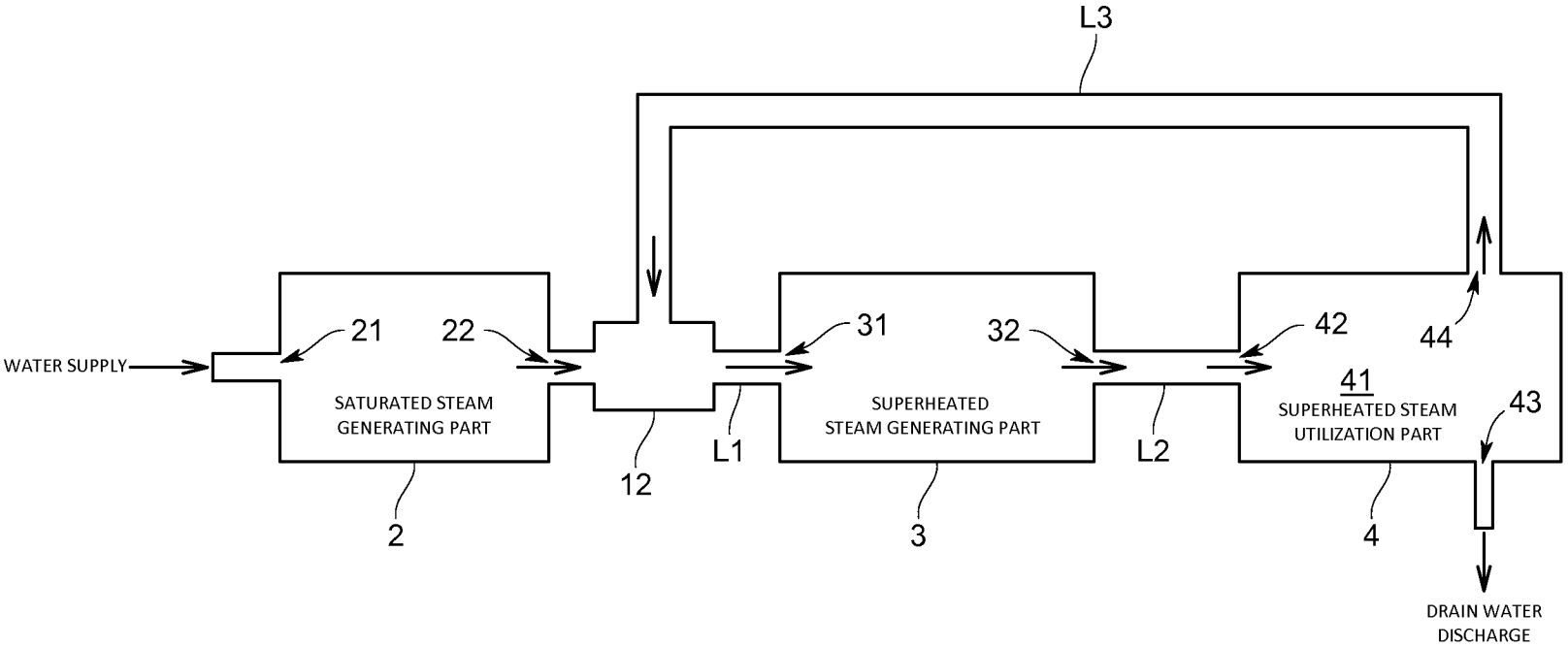
FIG. 3 is a diagram schematically illustrating a configuration of a superheated steam recycling apparatus of another embodiment.
Figure 4:
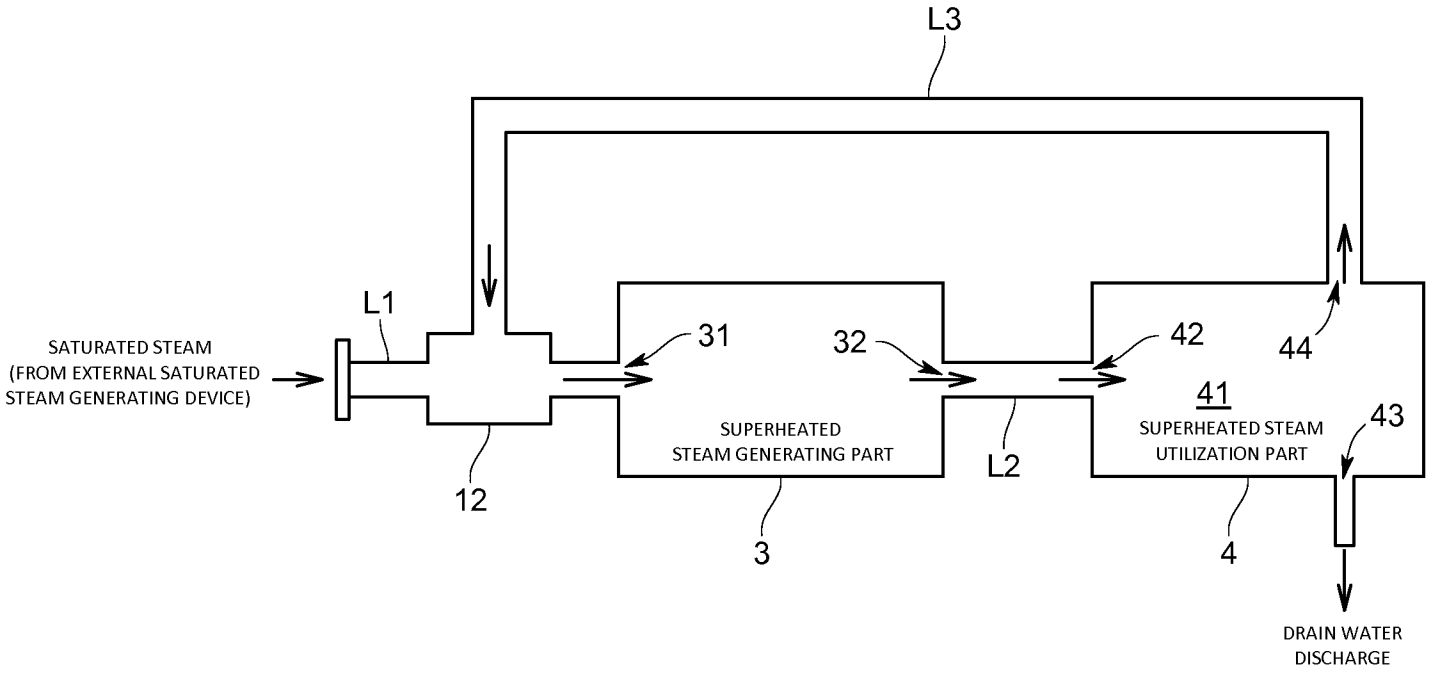
FIG. 4 is a diagram schematically illustrating a configuration of a superheated steam recycling apparatus of still another embodiment.

Also, as illustrated in FIGS. 3 and 4, the present invention may be configured to provide the steam supply flow path L1 with a steam ejector 12, and connect the steam return flow path L3 to the stem ejector 12. In doing so, the used steam is sucked by a negative pressure space formed inside the steam ejector 12 through the steam return flow path L3 and returned to the superheated steam generating part 3. As described, using the steam ejector 12 makes it possible to simplify a configuration of the superheated steam recycling apparatus, because even in the case of eliminating the need for the various devices provided in the steam return flow path L3, the used steam can be returned to the superheated steam generating part.

Still further, the arrangement order of the respective devices provided in the steam return flow path L3 is not limited to that in the above-described embodiment but can be appropriately changed.

In addition, the present invention may be configured to return the drain water produced in the superheated steam utilization part 4 to the tank 11 provided in the preceding stage of the saturated steam generating part 2.

Moreover, it goes without saying that the present invention is not limited to any of the above-described embodiments, but can be variously modified without departing from the scope thereof.

REFERENCE CHARACTERS LIST

100: Superheated steam recycling apparatus
L1: Saturated steam supply flow path
L2: Superheated steam supply flow path
L3: Steam return flow path
L4: Water return flow path
2: Saturated steam generating part
3: Superheated steam generating part
4: Superheated steam utilization part
5: Heating device
6: Impurity removing device
7: Steam-water separating device
8: Flowmeter
9: Air removing device
101: Pressurizing device
102: Depressurizing device
11: Tank

The invention claimed is:

1. A superheated steam recycling apparatus comprising:
a superheated steam generating part that generates superheated steam;
a steam supply flow path for supplying saturated steam or superheated steam to the superheated steam generating part;
a superheated steam utilization part that is supplied with the superheated steam generated by the superheated steam generating part and thermally processes a processing object with the superheated steam;
a steam return flow path for returning used steam having passed through the superheated steam utilization part to the superheated steam generating part;
a flowmeter that is provided in the steam return flow path to measure a flow rate of the used steam returned to the superheated steam generating part; and
a control device that controls a flow rate of the saturated steam or the superheated steam to be supplied to the superheated steam generating part through the steam supply flow path on the basis of a difference between a desired flow rate of the superheated steam to be generated by the superheated steam generating part and the flow rate of the used steam obtained by the flowmeter.

2. The superheated steam recycling apparatus according to claim 1, comprising
a heating device that is provided in the steam return flow path to perform heating such that the used steam keeps a temperature equal to or more than a boiling point from the superheated steam utilization part to the superheated steam generating part.

3. The superheated steam recycling apparatus according to claim 1, comprising
an air removing device that is provided in the steam return flow path to remove air contained in the used steam.

4. The superheated steam recycling apparatus according to claim 1, comprising
a steam ejector that is provided in the steam supply flow path, configured to be connected with the steam return flow path, and sucks the used steam through the steam return flow path.

5. The superheated steam recycling apparatus according to claim 1, comprising a saturated steam generating part that generates saturated steam, wherein the steam supply flow path connects the saturated steam generating part and the superheated steam generating part to each other.

6. The superheated steam recycling apparatus according to claim 5, comprising:

a steam-water separating device that is provided in the steam return flow path to remove moisture contained in the used steam; and a water return flow path for returning water to the saturated steam generating part, the water resulting from separation by the steam-water separating device.

7. A method for using a superheated steam recycling apparatus that comprises:

a superheated steam generating part that generates superheated steam;

a steam supply flow path for supplying saturated steam or superheated steam to the superheated steam generating part;

a superheated steam utilization part that is supplied with the superheated steam generated by the superheated steam generating part and thermally processes a processing object with the superheated steam;

a steam return flow path for returning used steam having passed through the superheated steam utilization part to the superheated steam generating part; and a flowmeter that is provided in the steam return flow path to measure a flow rate of the used steam returned to the superheated steam generating part, the method comprising:

controlling a flow rate of the saturated steam or the superheated steam to be supplied to the superheated steam generating part through the steam supply flow path on the basis of a difference between a desired flow rate of the superheated steam to be generated by the superheated steam generating part and the flow rate of the used steam obtained by the flowmeter.

* * * * *